US006786172B1

(12) United States Patent
Loffler

(10) Patent No.: US 6,786,172 B1
(45) Date of Patent: Sep. 7, 2004

(54) SHOCK ABSORBING BOAT

(76) Inventor: Leonard Loffler, 13301 SW. 83 Ct., Miami, FL (US) 33156

( * ) Notice: Subject to any disclaimer, the term of this patent is extended or adjusted under 35 U.S.C. 154(b) by 0 days.

(21) Appl. No.: 10/656,943

(22) Filed: Sep. 8, 2003

(51) Int. Cl.[7] ..... B63B 17/00
(52) U.S. Cl. ..... 114/363; 267/131
(58) Field of Search ..... 114/363, 364, 114/194; 248/585, 619; 267/117, 131, 132, 133; 297/195.1, 195.11

(56) References Cited

U.S. PATENT DOCUMENTS

| | | | | | |
|---|---|---|---|---|---|
| 4,425,863 | A | * | 1/1984 | Cutler | 114/363 |
| 4,901,968 | A | | 2/1990 | Ellis | 248/407 |
| 5,309,861 | A | * | 5/1994 | Mardikian | 114/363 |
| 5,367,978 | A | | 11/1994 | Mardikian | 114/363 |
| 5,465,679 | A | | 11/1995 | Mardikian | 114/363 |
| 5,542,371 | A | * | 8/1996 | Harvey et al. | 114/363 |
| 5,603,281 | A | * | 2/1997 | Harvey et al. | 114/363 |
| 5,639,059 | A | * | 6/1997 | Nash | 248/619 |
| 5,911,191 | A | * | 6/1999 | Burer | 114/363 |
| 6,042,093 | A | * | 3/2000 | Garelick | 267/131 |
| 6,098,567 | A | * | 8/2000 | Ullman | 114/363 |

* cited by examiner

*Primary Examiner*—S. Joseph Morano
*Assistant Examiner*—Lars A. Olson
(74) *Attorney, Agent, or Firm*—Laurence A. Greenberg; Werner H. Stemer; Gregory L. Mayback

(57) ABSTRACT

A watercraft or assembly for a watercraft will reduce the shock and vibration of high speed travel that is transmitted to the occupants. The assembly provides shock and vibration reduction to the seats and control console. The assembly is pivotally connected to the watercraft at an aft element such as the transom. When a vessel is under way at high speeds, the transom is subjected to the least up and down motion, and the bow to the greatest motion. The assembly of the invention includes a horizontal base that is hingedly connected to the transom to pivot about a horizontal axis. Since the transom suffers the least motion, the axis will be most stable. The base is supported by spring bias means connected to the hull. Shock absorbers may also be connected to reduce the vibration of the base when the hull is moving at high speeds. Seats, console, and floor or foot rests may all be mounted on the base so that the occupants are shielded from the vibrations of the hull. Even the standing operator is protected from vibration by standing on floor supported by the base.

8 Claims, 4 Drawing Sheets

SHOCK ABSORBING BOAT

This invention relates to watercraft and more particularly to means of reducing forces transmitted to boat occupants from a boat hull travelling at high speeds and in rough waters.

BACKGROUND OF THE INVENTION

When fast moving small watercraft encounter even moderately disturbed water, the occupants are subjected to uncomfortable vibration and shock. U.S. Pat. No. 5,465,679 issued Nov. 14, 1995 to Mardikian discloses shock-absorbing floorboards for a personal watercraft of the type operated in a standing position. U.S. Pat. No. 4,901,968 issued Feb. 20, 1990 to Ellis discloses a shock-absorbing seat for a Bass boat. U.S. Pat. No. 5,367,978 issued Nov. 29, 1994 to Mardikian discloses a pivoted shock absorbing seat for boats. Certain small watercraft have a helmsman's seat with a control panel and aft seats for other occupants. It would be useful if these elements could all be arranged with means for reducing shock and vibration transmitted therefrom to all these occupants. Prior art shock absorbing features are generally pivoted at a forward boat element. Since forward elements moves more than aft elements, it would be advantageous to pivot such features at the rearmost element.

SUMMARY OF THE INVENTION

It is accordingly an object of the invention to provide a watercraft or an assembly for a watercraft that will reduce the shock and vibration of high speed travel that is transmitted to the occupants. It is another object that the assembly provide shock and vibration reduction to the seats and control console. It is yet another object that the assembly be pivotally connected to the watercraft at an aft element such as the transom. When a vessel is under way at high speeds, the transom is subjected to the least up and down motion, and the prow to the greatest motion. The assembly of the invention includes a horizontal base that is hingedly connected to the transom to pivot about a horizontal axis. Since the transom suffers the least motion, the axis will be most stable. The base is supported by spring bias means connected to the hull. Shock absorbers may also be connected to reduce the vibration of the base when the hull is moving at high speeds. Seats, console, and floor or foot rests may all be mounted on the base so that the occupants are shielded from the vibrations of the hull. These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
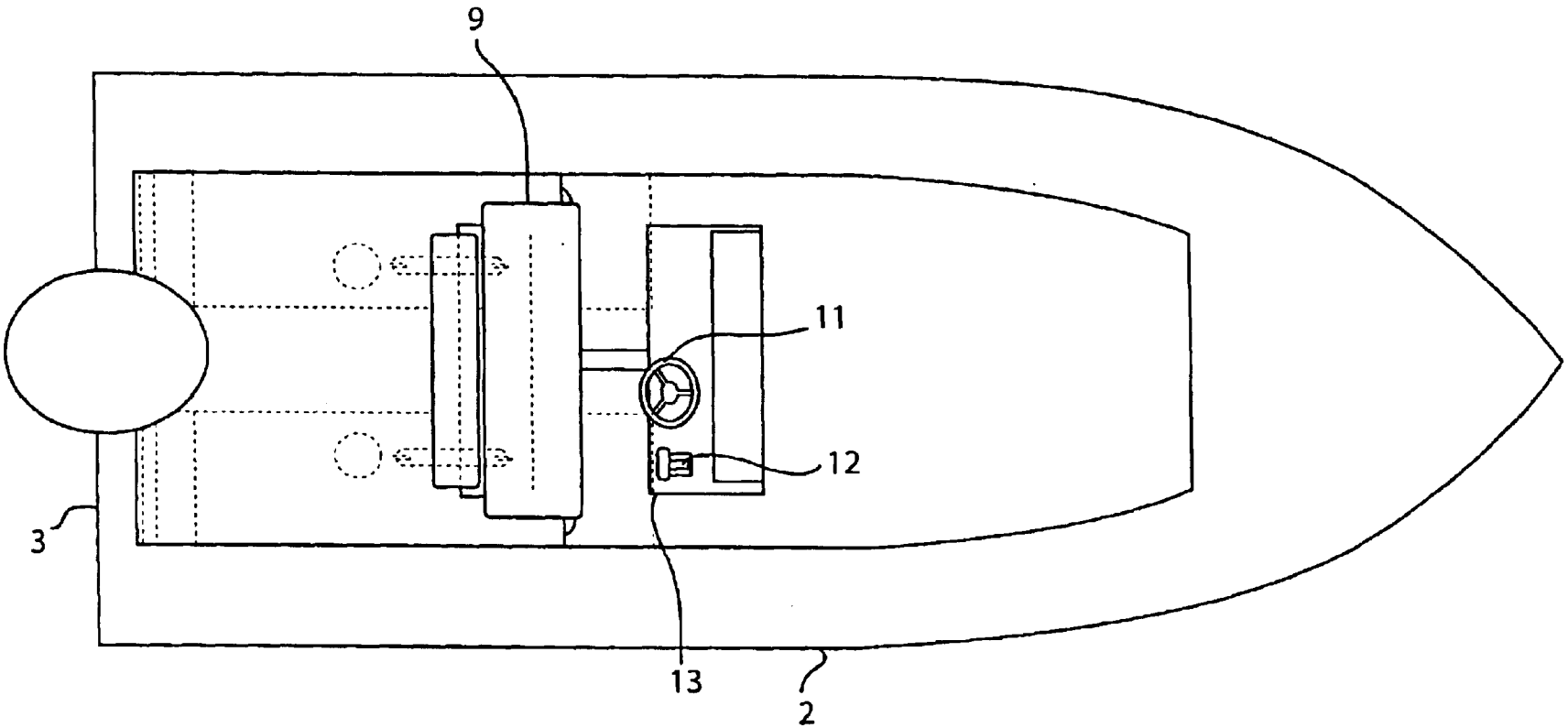
FIG. 1 is a top plan view of a first embodiment of the invention.
Figure 2:
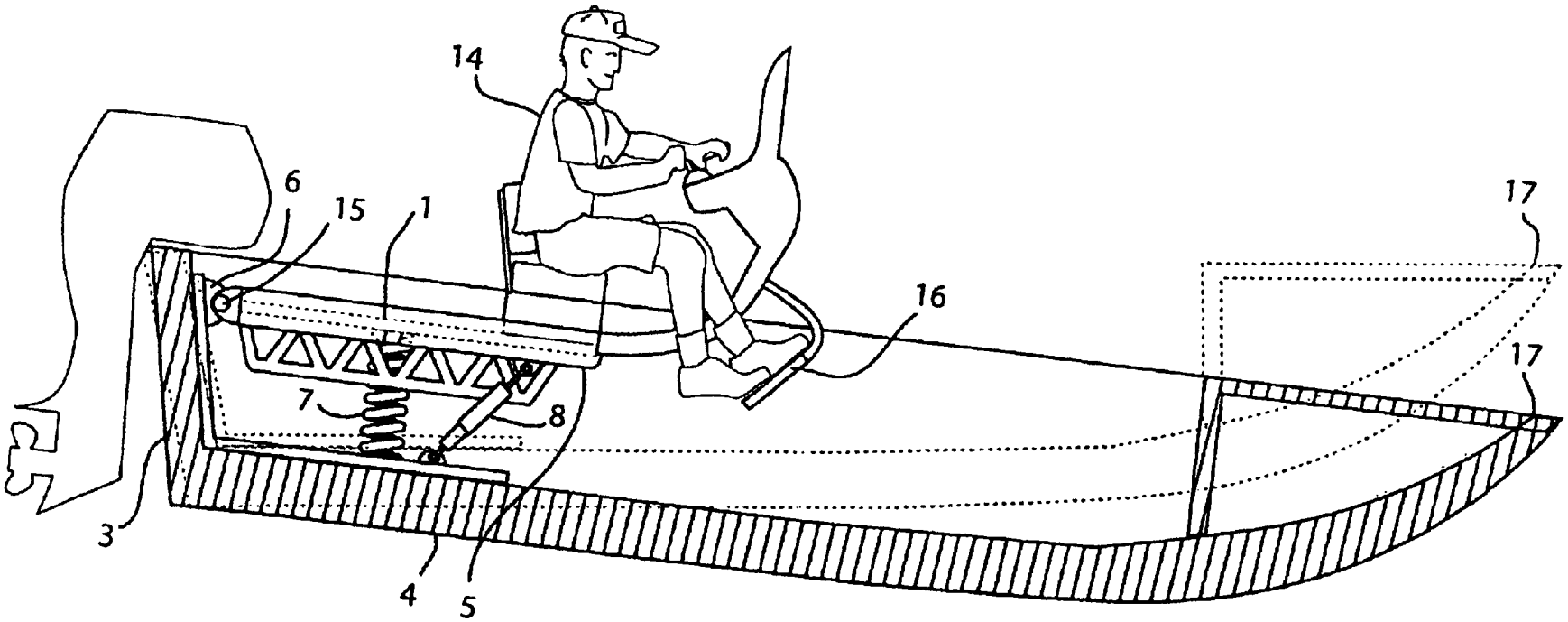
FIG. 2 is a side elevation view, partially in section of the first embodiment, with a second position of the watercraft shown in phantom.

Referring now to the drawing FIGS. 1 and 2, a center console watercraft 2 has a transom 3, and a hull bottom 4.

An assembly 1 comprises a substantially horizontal base 5 pivotally connected to the transom 3 by hinge connection 6 so as to pivot about a substantially horizontal axis 15. Mounted on the base 5 are a helm or steering apparatus 11, and controls 12 in a center console 13. A wide seat 9 that accommodates the helmsman or operator 14 with enough seating space for another passenger (not shown), and footrest 16 are also mounted on the base. A spring 7 and shock absorber 8 both have a first end connected to the base 5 and a second end connected to the hull bottom 4.

As shown in phantom in FIG. 2, when the hull bow 17 is lifted by a wave, the base 5 and the items supported thereon tend to remain horizontal, because the base is pivoting on the axis 15 attached to the transom 3, which moves much less than the bow. The spring 7 and shock absorber 8 cushion and absorb much of the motion and vibration that would otherwise be transmitted to the occupants.

Figure 3:
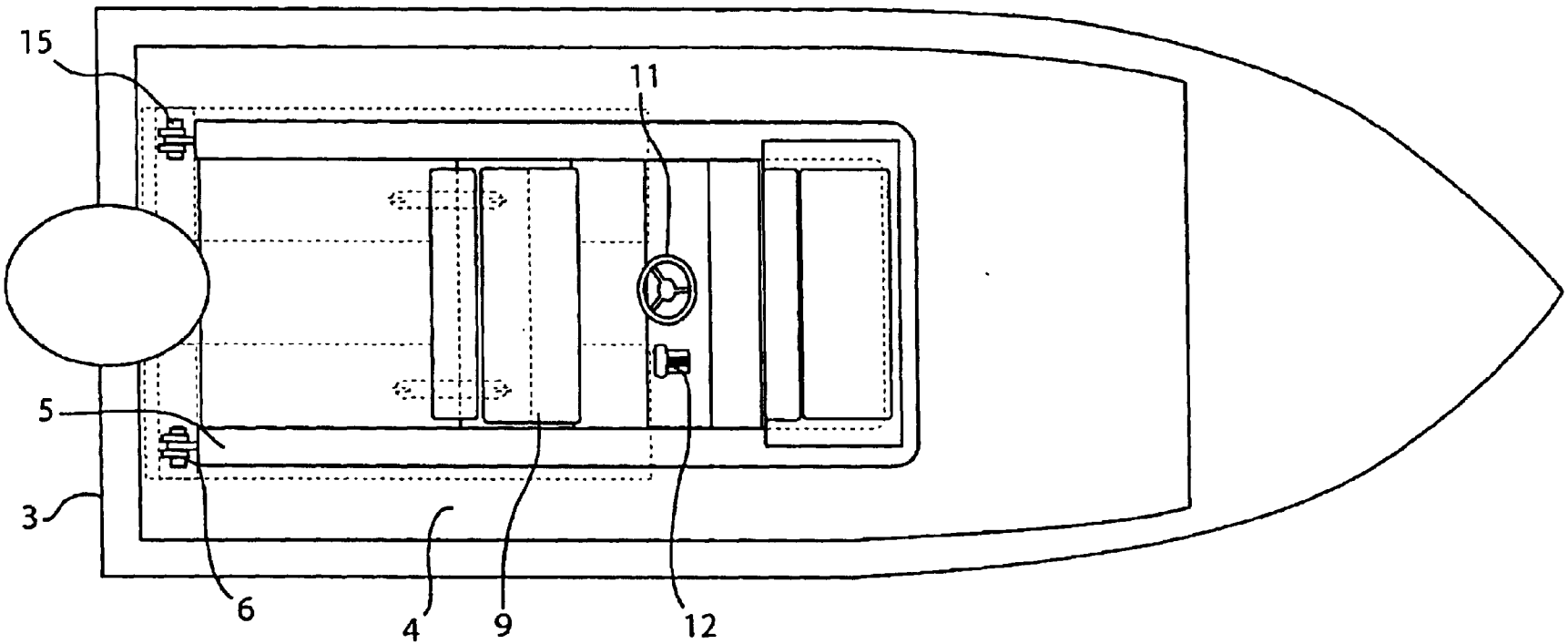
FIG. 3 is a top plan view of a second embodiment of the invention.
Figure 4:
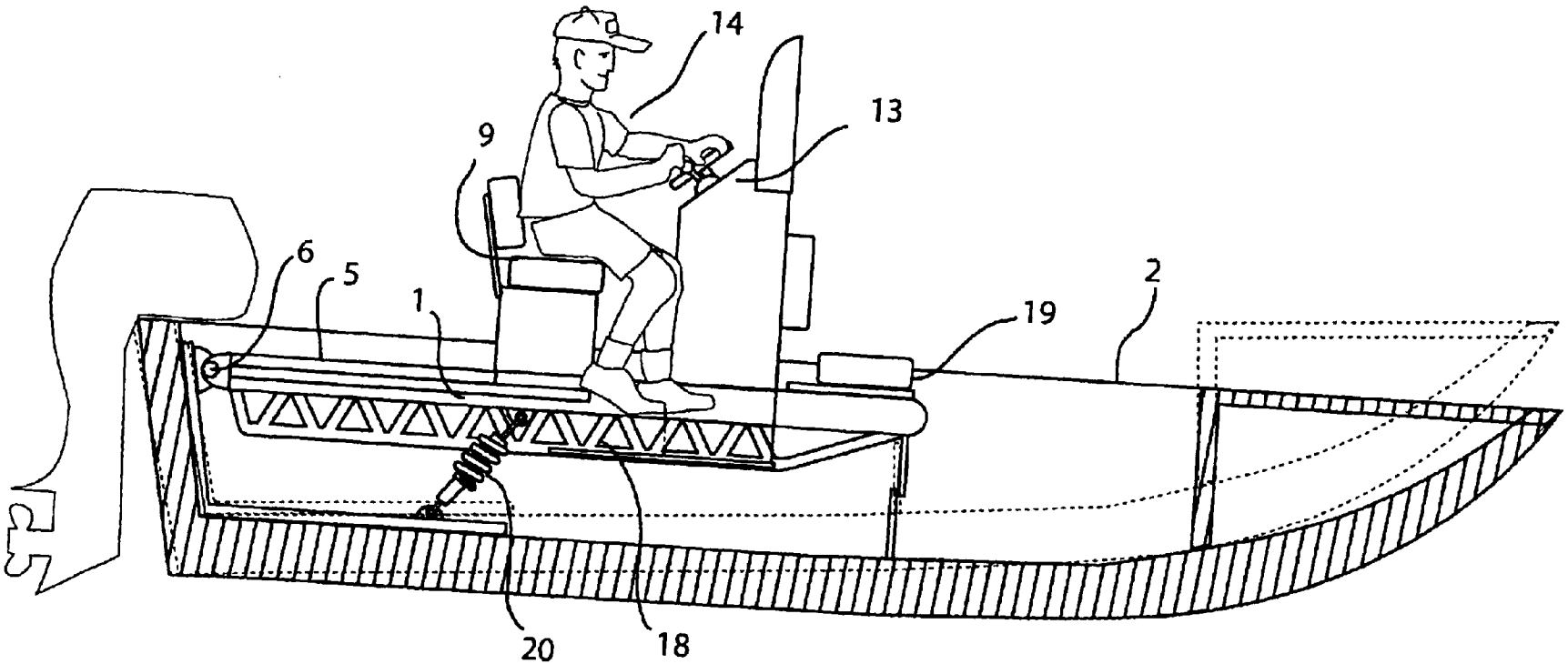
FIG. 4 is a side elevation view, partially in section of the second embodiment, with a second position of the watercraft shown in phantom.

Referring now to the drawing FIGS. 3 and 4, a flats type watercraft 2' has a transom 3', and a hull bottom 4'. An assembly 1' comprises a substantially horizontal base 5' pivotally connected to the transom 3' by hinge connection 6' so as to pivot about a substantially horizontal axis 15'. Mounted on the base 5' are a helm or steering apparatus 11', and controls 12' in a center console 13'. A wide seat 9' that accommodates the helmsman or operator 14 with enough seating space for another passenger (not shown), a forward seat 19 and floor 18 are also mounted on the base. A combined spring and shock absorber assembly 20 has a first end connected to the base 5' and a second end connected to the hull bottom 4'. It is common for an operator to stand while operating this type of boat. By insulating the floor from vibration, the standing operator is protected from much of the discomfort that is usually experienced.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An assembly for a watercraft having a transom, and a hull bottom, the assembly comprising:

a) a substantially horizontal base pivotally connected to the transom to pivot about a substantially horizontal axis;

b) spring bias means connected at a first end to the base and at a second end to the hull bottom;

c) shock absorber means connected at a first end to the base and at a second end to the hull bottom, wherein the spring bias means and shock absorber means reduce transmission of vibration from the hull to the base and items mounted thereon;

d) at least one seat mounted on the base;

e) a control console attached to the base; and f) foot support means attached to the base.

2. The assembly according to claim 1 in which the foot support means includes floor on which an occupant might stand while piloting the watercraft.

3. The assembly according to claim 1 in which the spring bias means and shock absorber means are contained in a combined unit.

4. An assembly for a watercraft having a transom, and a hull bottom, the assembly comprising:

a) a base hingedly attached to the transom to pivot about a substantially horizontal axis;

b) spring bias means connected at a first end to the base and at a second end to the hull bottom;

c) shock absorber means connected at a first end to the base and at a second end to the hull bottom, wherein the spring bias means and shock absorber means reduce transmission of vibration from the hull to the base and items mounted thereon;

d) at least one seat mounted on the base; and e) control means attached to the base.

5. The assembly according to claim 1 in which the spring bias means and shock absorber means are contained in a combined unit.

6. A watercraft having a transom, and a hull bottom comprising:

a) a substantially horizontal base pivotally connected to the transom to pivot about a substantially horizontal axis;

b) spring bias means connected at a first end to the base and at a second end to the hull bottom;

c) shock absorber means connected at a first end to the base and at a second end to the hull bottom, wherein the spring bias means and shock absorber means reduce transmission of vibration from the hull to the base and items mounted thereon;

d) at least one seat mounted on the base;

e) a control console attached to the base; and f) foot support means attached to the base.

7. The watercraft according to claim 6 in which the foot support means includes floor on which an occupant might stand while piloting the watercraft.

8. The watercraft according to claim 6 in which the spring bias means and shock absorber means are contained in a combined unit.

* * * * *

UNITED STATES PATENT AND TRADEMARK OFFICE

CERTIFICATE OF CORRECTION

PATENT NO. : 6,786,172 B1 
DATED : September 7, 2004
INVENTOR(S) : Leonard Loffler It is certified that error appears in the above-identified patent and that said Letters Patent is hereby corrected as shown below:

Drawings,
Figure 3 should appear as follows:

Fig. 3

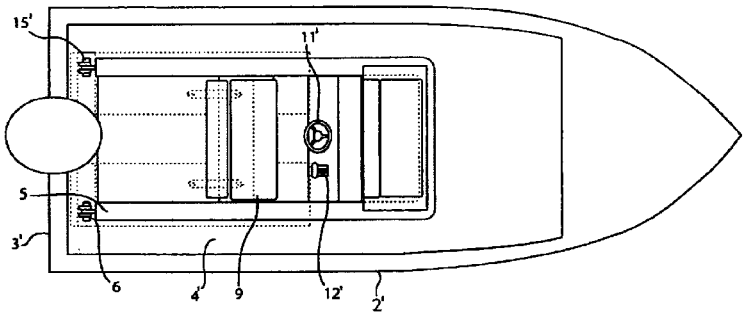

Figure 4 should appear as follows:

Fig. 4

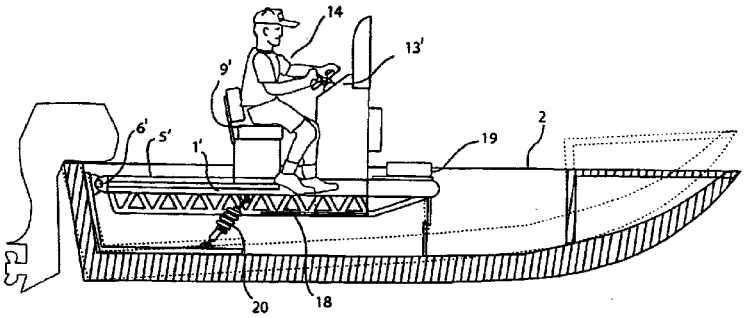

Signed and Sealed this

Twenty-third Day of August, 2005

JON W. DUDAS
*Director of the United States Patent and Trademark Office*